US007260871B2

(12) United States Patent
Borchardt et al.

(10) Patent No.: US 7,260,871 B2
(45) Date of Patent: Aug. 28, 2007

(54) VENTABLE INTERLOCKING CLOSURE STRIP

(75) Inventors: Michael G. Borchardt, Naperville, IL (US); Ewald A. Kamp, deceased, late of Fort Lauderdale, FL (US); by Peggy Golden, legal representative, Fort Lauderdale, FL (US)

(73) Assignee: The Clorox Company, Oakland, CA (US)

( * ) Notice: Subject to any disclaimer, the term of this patent is extended or adjusted under 35 U.S.C. 154(b) by 185 days.

(21) Appl. No.: 10/832,153

(22) Filed: Apr. 26, 2004

(65) Prior Publication Data

US 2005/0235467 A1 Oct. 27, 2005

(51) Int. Cl.
*B65D 33/16* (2006.01)

(52) U.S. Cl. ..... 24/399; 24/400; 383/63; 383/100

(58) Field of Classification Search ..... 24/399–402, 24/585.1, 585.11, 585.12, 586.1, 586.11, 24/DIG. 50, DIG. 39, 604, DIG. 51; 383/63–65, 383/45, 100–103
See application file for complete search history.

(56) References Cited

U.S. PATENT DOCUMENTS 2,354,485 A * 7/1944 Slaughter ..... 52/578
4,186,786 A 2/1980 Kirkpatrick
4,285,105 A 8/1981 Kirkpatrick
4,532,652 A * 7/1985 Herrington ..... 383/103
4,736,496 A 4/1988 Fisher et al.
4,829,641 A * 5/1989 Williams ..... 24/585.12
4,841,603 A * 6/1989 Ragni ..... 24/584.1
4,907,321 A * 3/1990 Williams ..... 24/585.12
5,059,036 A 10/1991 Richison et al.
5,070,584 A 12/1991 Dais et al.
5,138,750 A 8/1992 Gundlach et al.
5,140,727 A 8/1992 Dais et al.
5,192,135 A * 3/1993 Woods et al. ..... 383/63
5,248,201 A 9/1993 Kettner et al.
5,307,552 A 5/1994 Dais et al.
5,356,222 A * 10/1994 Kettner et al. ..... 383/63
5,363,540 A 11/1994 Dais et al.
5,403,094 A * 4/1995 Tomic ..... 383/63
5,405,478 A 4/1995 Richardson et al.
5,554,093 A 9/1996 Porchia et al.
5,647,100 A 7/1997 Porchia et al.
5,722,128 A 3/1998 Toney et al.
5,774,955 A * 7/1998 Borchardt et al. ..... 24/584.1
5,829,884 A 11/1998 Yeager (Continued)

FOREIGN PATENT DOCUMENTS

EP 0510797 10/1992

(Continued)

*Primary Examiner*—Jack W. Lavinder
(74) *Attorney, Agent, or Firm*—Ann Lee

(57) ABSTRACT

The invention generally relates to interlocking closure devices including two closure elements arranged to be interlocked over a predetermined length. The closure elements permit the venting of fluids when the closure elements are in their occluded vented position. The closure elements have an occluded closed position which creates a seal and prevents fluids from passing between the interlocking closure elements. The closure fastening device may be utilized with a flexible container and is advantageous in permitting a user to vent excess air from the interior of the flexible container prior to sealing the container.

39 Claims, 6 Drawing Sheets

U.S. PATENT DOCUMENTS

| | | | | |
|---|---|---|---|---|
| 5,839,831 | A | 11/1998 | Mazzocchi | |
| 5,878,468 | A | 3/1999 | Tomic et al. | |
| 5,911,508 | A | 6/1999 | Dobreski et al. | |
| 6,082,897 | A | 7/2000 | Galomb | |
| 6,152,600 | A | 11/2000 | Tomic | |
| 6,217,215 | B1 | 4/2001 | Tomic | |
| 6,231,236 | B1 | 5/2001 | Tilman | |
| 6,371,644 | B1 | 4/2002 | Forman | |
| 6,594,872 | B2 * | 7/2003 | Cisek | 24/401 |
| 6,692,147 | B2 * | 2/2004 | Nelson | 383/63 |
| 6,713,152 | B2 | 3/2004 | Chen et al. | |
| 2004/0013323 | A1 | 1/2004 | Withers | |
| 2004/0047521 | A1 | 3/2004 | Berich et al. | |
| 2004/0049896 | A1 * | 3/2004 | Savicki | 24/399 |
| 2004/0074799 | A1 | 4/2004 | Bell et al. | |
| 2004/0234170 | A1 | 11/2004 | Pawloski et al. | |
| 2004/0234171 | A1 | 11/2004 | Dais et al. | |
| 2004/0252915 | A1 | 12/2004 | Nelson | |
| 2005/0235468 | A1 * | 10/2005 | Borchardt et al. | 24/399 |
| 2006/0008184 | A1 * | 1/2006 | Borchardt et al. | 383/63 |
| 2006/0104548 | A1 * | 5/2006 | Schreiter | 383/63 |
| 2006/0168775 | A1 * | 8/2006 | Turvey et al. | 24/399 |

FOREIGN PATENT DOCUMENTS

| | | |
|---|---|---|
| GB | 1260764 | 1/1972 |

* cited by examiner

VENTABLE INTERLOCKING CLOSURE STRIP

FIELD OF THE INVENTION

This invention relates to interlocking closure strips which permit fluids, such as gases and liquids, to be vented when the closure strips are engaged. These interlocking closure strips may be employed as fasteners in traditional fastener areas and find particular use as closures for storage containers, e.g., plastic bags.

BACKGROUND OF THE INVENTION

The use of fastening devices for the closure of containers, including plastic bag bodies, is generally known. Furthermore, the manufacture of closure fastening devices made of plastic materials is generally known to those skilled in the art relating to closure fastening devices as demonstrated by the numerous patents in this area.

A particularly well-known use for closure fastening devices is in connection with a flexible container, e.g., bag bodies. The closure fastening device and the associated container may be formed from thermoplastic materials. In addition, the closure fastening device and side walls of the container can be integrally formed by extrusion as a single piece, or may be formed as separate pieces and then connected by heat sealing or other suitable means.

The flexible containers are widely used to store and preserve food. The closure fastening devices allow the food to be stored in the air-tight flexible container. Although air-tight closure devices are preferred to preserve the food, it is difficult to exhaust air from the flexible container upon closure as noted in U.S. Pat. No. 4,532,652. In order to vent the air from the flexible container, the user must coordinate his or her movements. First, the flexible container which is filled with food is substantially, but not completely, closed. Second, the air is exhausted by pressing on the side walls of the bag. Finally, the bag is completely closed before a substantial amount of air reenters the bag. The movements required are cumbersome and are not easily performed by those lacking a high degree of dexterity and coordination. In addition, the bag is not sufficiently vented of the air which decreases the ability of the sealed bag to maintain food freshness.

Some storage bags have utilized a valve such as U.S. Pat. No. 4,532,652, or a venting structure such as U.S. Pat. No. 4,834,554, to allow air inside the bag to escape to the exterior of the bag. However, such devices are not able to permit the user to seal the bag in order to prevent further air from exiting or entering the bag, are more complicated and are more expensive to manufacture.

SUMMARY OF THE INVENTION

The instant invention generally relates to interlocking closure devices including two closure elements arranged to be interlocked over a predetermined length. The closure elements permit the venting of fluids when the closure elements are in their occluded vented position. The closure elements have an occluded closed position which creates a seal and prevents fluids from passing between the interlocking closure elements.

The closure fastening device includes a male element portion which has a base portion, a pair of first webs extending in generally equal but opposite angles from the base portion and male hook portions extending from the webs and facing away from each other. The male hook portions include guide surfaces which serve to guide the hook portions for occlusion with the female hook portions of a mating closure element.

The interlocking closure device includes a female element portion which has a base portion, a pair of spaced-apart parallelly disposed webs extending in a generally normal direction from the base portion and female hook portions extending from the webs and facing towards each other. The female hook portions have a rounded crown surface or an angled guide surface which serves to guide the hook portions for occlusion with the male hook portions of a mating closure element.

In accordance with the invention, the closure fastening device may be utilized with a flexible container and is advantageous in permitting a user to vent excess air from the interior of the flexible container prior to sealing the container. Specifically, the user would open the flexible container by pulling on the mouth portions to open the closure fastening device. The user would then insert a food product or other items into the interior of the flexible container. After the user had filled the flexible container with the desired quantity of food product or other items, the user would move the closure fastening device to the vented position. The user would then press on the side walls of the flexible container to force the air from the interior of the container between the male element portion and the female element portion. After the desired amount of air had been expelled from the interior of the flexible container, the user would then move the male element portion and the female element portion to the closed position. When the male element portion and the female element portion are in the closed position, the flexible container is sealed and neither the contents including fluids can escape nor can fluids enter the flexible container.

One object of this invention is to provide an interlocking closure device including two closure elements arranged to be interlocked over a predetermined length.

Another object of this invention is to provide an interlocking closure device which has one position for allowing fluids, especially air, to pass between the interlocking closure device and a second position for preventing fluids, particularly air, from passing through the interlocking closure device.

An additional object of this invention is to provide an interlocking closure device which has a tactile "feel" as the closure device is occluded.

A further object of this invention is to provide an interlocking closure device which is easy for the user to operate and inexpensive to manufacture.

Another object of this invention is to provide a flexible container which includes an interlocking closure device and satisfies the objects noted above.

Other objects and advantages of the invention will be apparent upon reading the following detailed description and appended claims, and upon reference to the accompanying drawings.

DETAILED DESCRIPTION OF THE INVENTION

The instant invention provides interlocking closure devices which permit the venting of fluids when the interlocking closure devices are in their occluded vented position. The interlocking closure devices have an occluded closed position which creates a seal and prevents fluids from passing between the interlocking closure devices. The interlocking closure devices include two closure elements arranged to be interlocked over a predetermined length.

The terms "male" and "female" closure element are generally understood in the art as closure elements wherein the element that interlocks into the other closure element and having outwardly projecting hooks is referred to as the "male closure element" and the outer element is referred to as the "female closure element" and has inwardly projecting hooks. These terms have been employed to define closure elements without any guide members.

Figure 1:
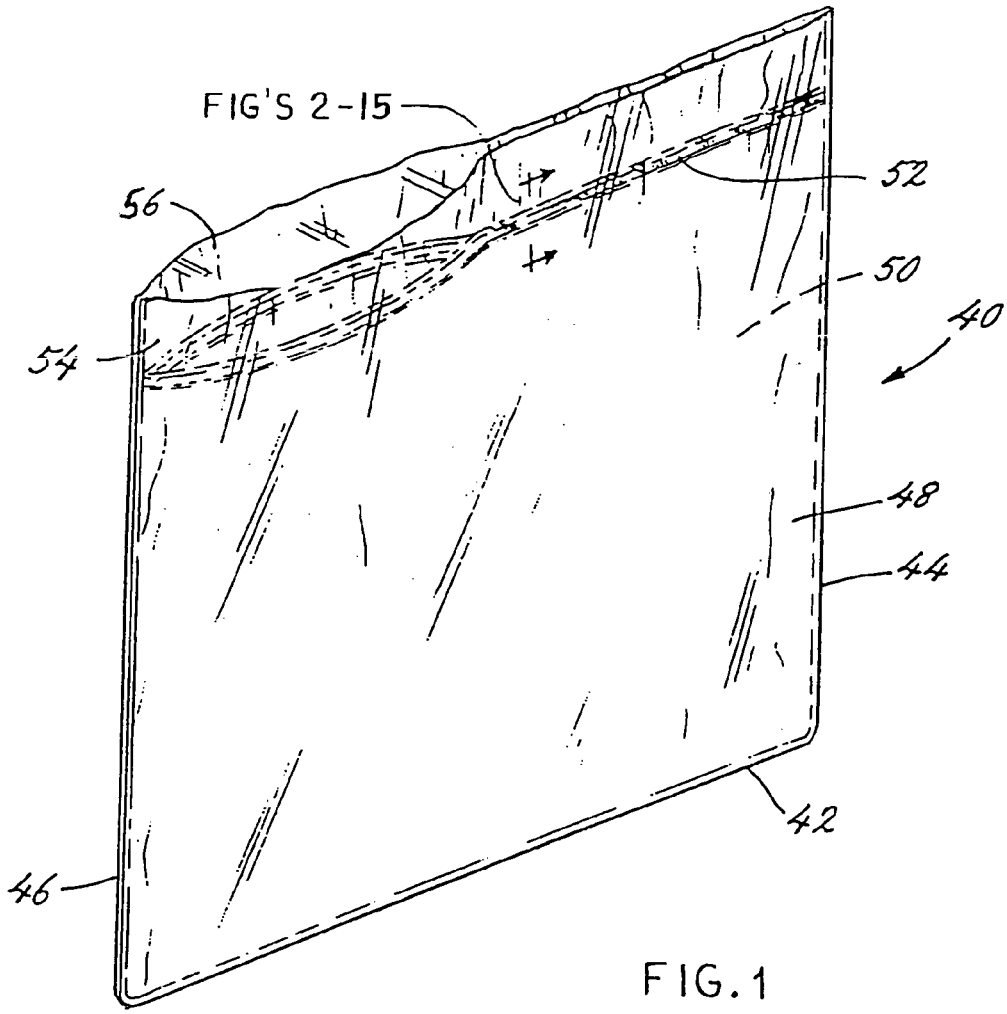
FIG. 1 is a perspective view of a flexible container including a closure fastening device in accordance with the invention.

Referring to FIG. 1, a typical flexible container 40 is formed from a thin, plastic film which is folded at a bottom portion 42 and heat sealed along vertical side edges 44, 46 to form a pouch. The flexible container includes side walls 48, 50 which extend beyond the closure fastening device 62 to provide mouth portions 54, 56 to simplify the opening of closure fastening device 52.

Figure 2:
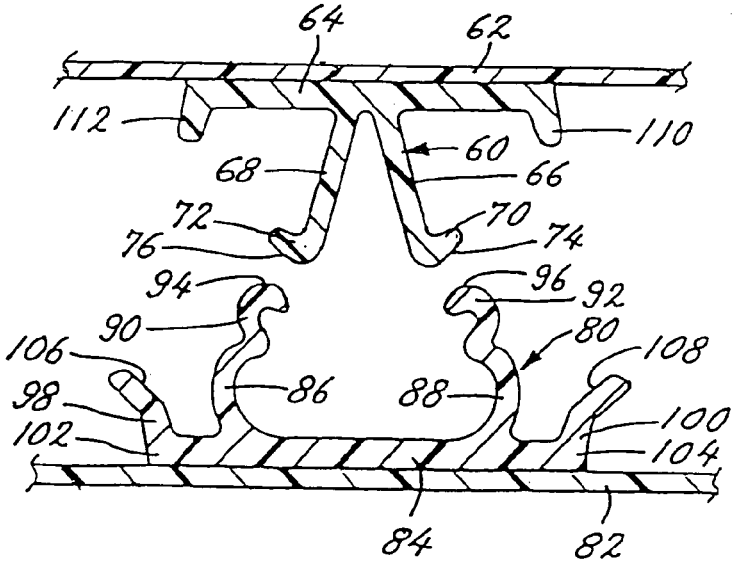
FIG. 2 is a partial cross-sectional view along line 2-2 in FIG. 1 of one embodiment of the closure fastening device shown in a non-occluded position.

One embodiment of the closure fastening device is shown in FIG. 2 and is indicated generally by the reference numeral 52. The closure fastening device 52 includes a male element portion 60. The male element portion 60 is connected to a flange portion 62 and includes a base portion 64, a pair of first webs 66 and 68 extending in generally equal but opposite angles from the base portion 64, and male hook portions 70 and 72 extending from webs 66, 68, respectively, and facing away from each other. The male hook portions 70, 72 include guide surfaces 74, 76 which serve to guide the hook portions for occlusion with the female hook portions of a mating closure element.

The closure fastening device 52 includes a female element portion 80. The female element portion is connected to a flange portion 82 and includes a base portion 84, a pair of spaced-apart, parallelly disposed webs 86, 88 extending from base portion 84 and female hook portions 90, 92 extending from webs 86, 88, respectively, and facing towards each other. The female hook portions have a rounded crown surface 94, 96 which serves to guide the hook portions for occlusion with the male hook portions of a mating closure element.

Closure elements 60, 80 shown in FIG. 2 may be separately formed and therefore connected to a film which forms side walls of a bag body, or they may be integrally formed with such side walls.

Guide members may be added to provide improved "feel" to the closure device and may be provided in the shape of triangles, rectangles or other suitable shapes and are generally provided by extrusion as an integral part of the male and/or female closure elements. Further, the guide members may be provided as outer alignment members that guide the male and female closure elements towards each other. In one embodiment, the guide members extend from the flange portion on each side of the female closure element in a generally perpendicular direction at the base with an outwardly bending top member such that a funneling-type direction orientation is provided as the male closure element is brought into contact with the female closure element.

Referring to FIG. 2, a second pair of spaced-apart, parallelly disposed second webs, 98, 100 are spaced apart on either outward side of the first spaced-apart webs 86, 88 and extend in a generally normal direction at portions 102, 104 from the base portion 84 with generally outwardly projecting guide surfaces 106, 108, respectively, to provide guide surfaces for the male closure element. The male closure element portion 60 may include a second pair of spaced-apart, parallelly disposed second webs 110, 112 which are spaced apart on either outward side of the first spaced-apart webs 66, 68 and extend in a generally normal direction from base portion 64.

Figure 3:
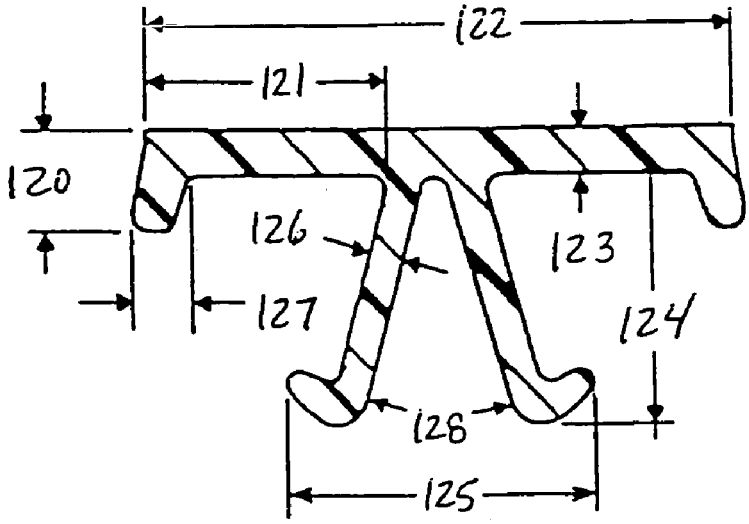
FIG. 3 is a cross-sectional view of one embodiment of the male closure element according to the invention showing the relative dimensions of the various elements of the male closure element.

The actual dimensions of a representative male closure element is shown in FIG. 3 where the values for the dimensional parameters on FIG. 3 are given in mils:

| Parameter | Range (Mils) | Preferred (Mils) |
|---|---|---|
| 120 | .006-.056 | .031 |
| 121 | .044-.124 | .084 |
| 122 | .164-.244 | .204 |
| 123 | .010-.020 | .015 |
| 124 | .047-.117 | .082 |
| 125 | .061-.141 | .101 |
| 126 | .010-.020 | .015 |
| 127 | .006-.030 | .018 |

| | Range (Degrees) | Preferred (Degrees) |
|---|---|---|
| Angle 128 | 22-42 | 32 |

Figure 4:
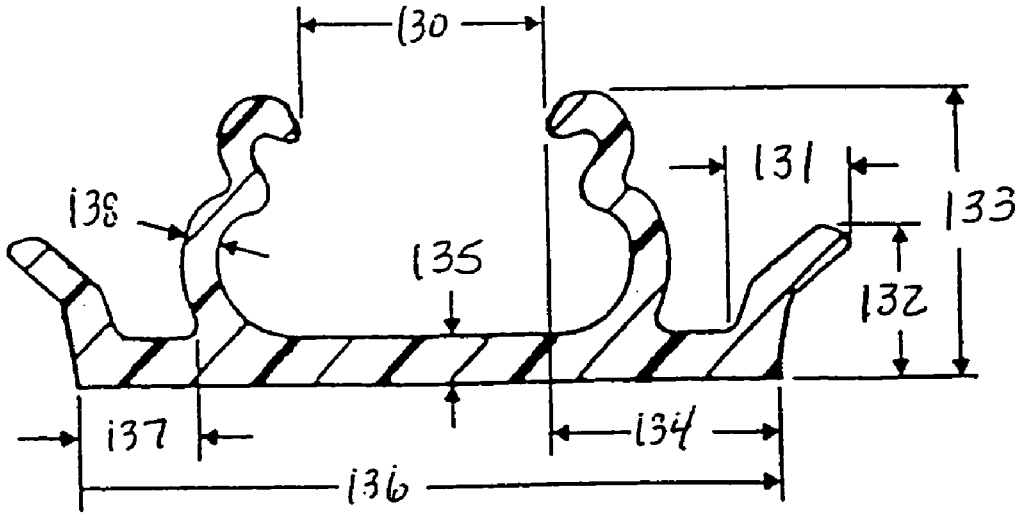
FIG. 4 is a cross-sectional view of one embodiment of the female closure element according to the invention suitable for use with the male closure element of FIG. 3 and showing the relative dimensions of the various elements of the female closure element.

A female closure element for use in conjunction with the male closure element shown in FIG. 4 wherein the dimensional parameters are given in mils:

| Parameter | Range (Mils) | Preferred (Mils) |
|---|---|---|
| 130 | .048-.128 | .088 |
| 131 | .020-.060 | .040 |
| 132 | .022-.072 | .047 |
| 133 | .059-.129 | .094 |
| 134 | .040-.120 | .080 |
| 135 | .010-.020 | .015 |
| 136 | .210-.290 | .250 |
| 137 | .014-.054 | .034 |
| 138 | .010-.020 | .015 |

Figure 5:
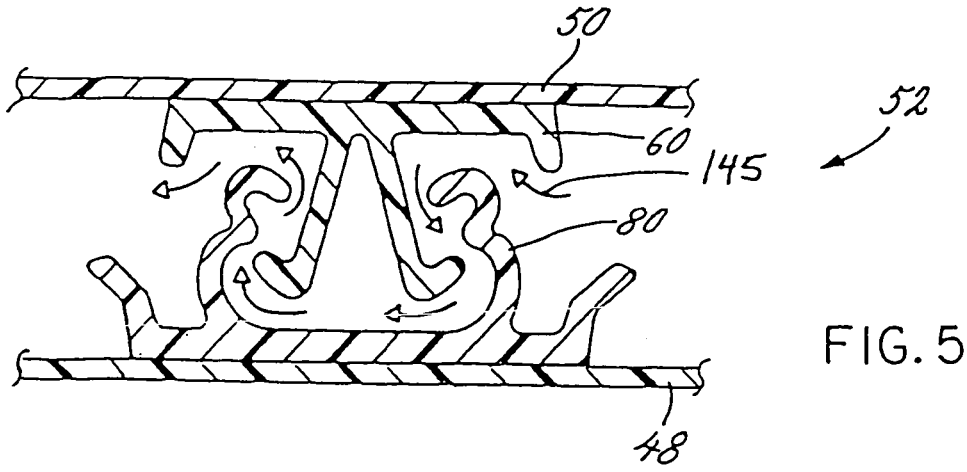
FIG. 5 is a cross-sectional view of one embodiment of the closure fastening device in accordance with the invention in an occluded vented position.

FIG. 5 is similar to FIG. 2 and shows the male and female closure elements of FIG. 2 in an occluded venting position. As shown in FIG. 5, this position allows fluids 145 to pass between the male element portion 60 and the female element portion 80.

Figure 6:
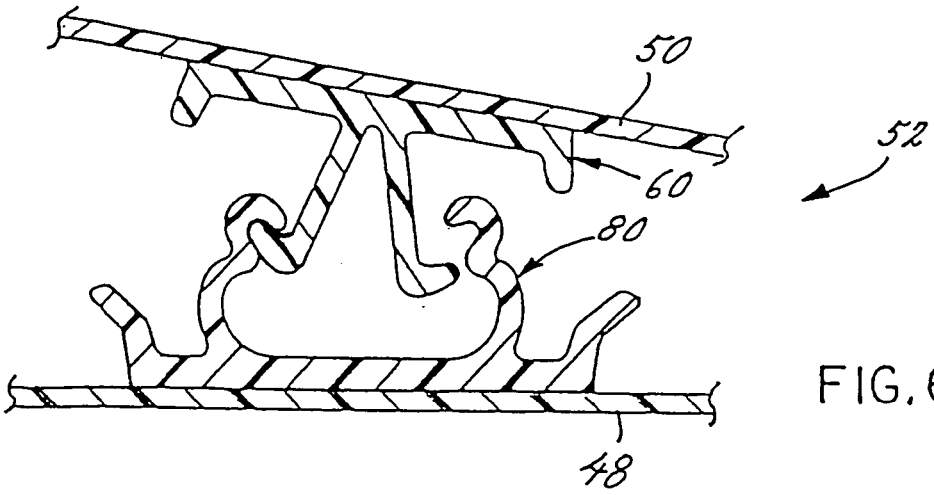
FIG. 6 is a cross-sectional view of the closure fastening device shown in FIG. 5 in an intermediate occluded position.
Figure 7:
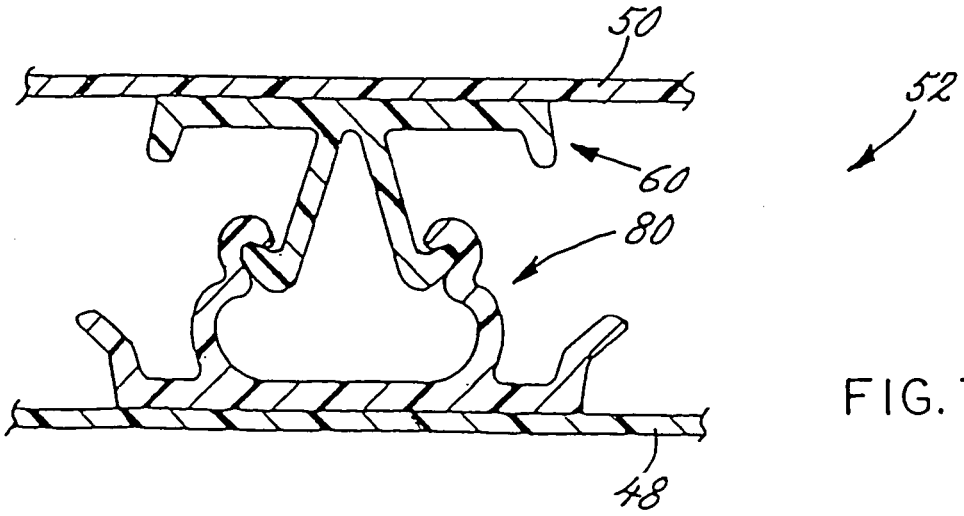
FIG. 7 is a cross-sectional view of the closure fastening device shown in FIGS. 2-6 in an occluded closed position.

In FIG. 6, the male element portion 60 and the female element portion 80 are being moved away from each other from the occluded vented position shown in FIG. 5 to the occluded closed position shown in FIG. 7. In FIG. 7, the male element portion 60 and the female element portion 80 are shown in the occluded closed position which creates a seal between the male element portion 60 and the female element portion 80 and prevents fluids from moving between the element portions.

As shown in FIGS. 2-4, the dimension 125 for first webs 66, 68 is smaller than the dimension 130 for webs 86, 88. This dimensional relationship creates a restriction when the male element portion 60 and the female element portion are in the occluded closed position as in FIG. 7. However, the dimensional relationship does not create a restriction when the male element portion 60 and the female element portion 80 are in the occluded venting position as in FIG. 5.

In accordance with the invention, the closure fastening device 52 may be utilized with a flexible container such as the container 40 shown in FIG. 1. Thus, the container 40 with the closure fastening device may be used as a conventional flexible container in the conventional manner.

In addition, the user has the option of using the venting capabilities of this invention. This invention is advantageous in permitting a user to vent excess air from the interior of the flexible container prior to sealing the container. Specifically, the user would open the flexible container 40 by pulling on the mouth portions 54, 56 to open the closure fastening device 52. The user would then insert a food product or other items into the interior of the flexible container. After the user had filled the flexible container with the desired quantity of food product or other items, the user would then close or occlude the closure fastening device 52. The closure fastening device 52 would be in the occluded vented position which is shown in FIG. 5. The user would then press on the side walls 48, 50, also shown in FIG. 1, to force the air from the interior of the flexible container to the exterior of the container. Specifically, the air would flow from the interior of the container between the male element portion 60 and the female element portion 80 and to the exterior of the flexible container as represented by the air flow 145 in FIG. 5.

After the desired amount of air had been expelled from the interior of the flexible container, the user would then move the male element portion 60 and the female element portion 80 to the occluded closed position shown in FIG. 7. Specifically, the user would pull outward on the mouth portions 54, 56 to move the male and female element portions 60, 80 to the occluded closed position. As the male element portion 60 and the female element portion 80 are moving toward the occluded closed position shown in FIG. 7, they may be rotated or achieve temporarily an orientation shown in FIG. 6. When the male element portion 60 and the female element portion 80 are in the occluded closed position as shown in FIG. 7, the flexible container is sealed and fluids can neither escape nor enter the flexible container.

Also, the container 40 with the venting closure fastening device of this invention could be used with the method of venting used for conventional flexible containers with non-venting interlocking closures. However, unlike conventional containers, the venting closure of this invention will not tend to lose the contents of the container during the venting procedures and will minimize the amount of air which reenters the container. If the user wants to utilize the conventional venting or burping method, then the user would modify the method described above. After placing the food product or other items into the flexible container, the user would position the male element portion 60 and the female element portion 80 in the occluded closed position as shown in FIG. 7 along substantially the entire length of the closure fastening device 52 except for a relatively small length. The user would then expel the excess air from the interior of the container through the short length of the closure fastening device 52 which is in the occluded vented position as shown in FIG. 5. After the desired amount of air has been expelled, the user could then quickly move the male element portion 60 and the female element portion 80 to the occluded closed position as shown in FIG. 7 before any air on the exterior of the container was allowed to reenter the interior of the container.

Figure 8:
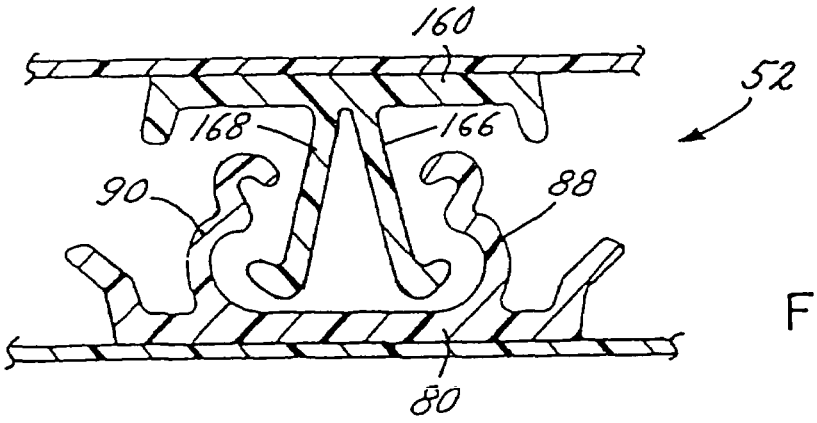
FIG. 8 is a cross-sectional view of another embodiment of the closure fastening device in accordance with the invention in an occluded vented position and having male webs which are relatively longer than the female webs of the female closure element.

FIG. 8 is similar to FIG. 5, except the first webs 166, 168 on the male element portion 160 are relatively longer than the first webs 88, 90 on the female element portion 80.

Figure 9:
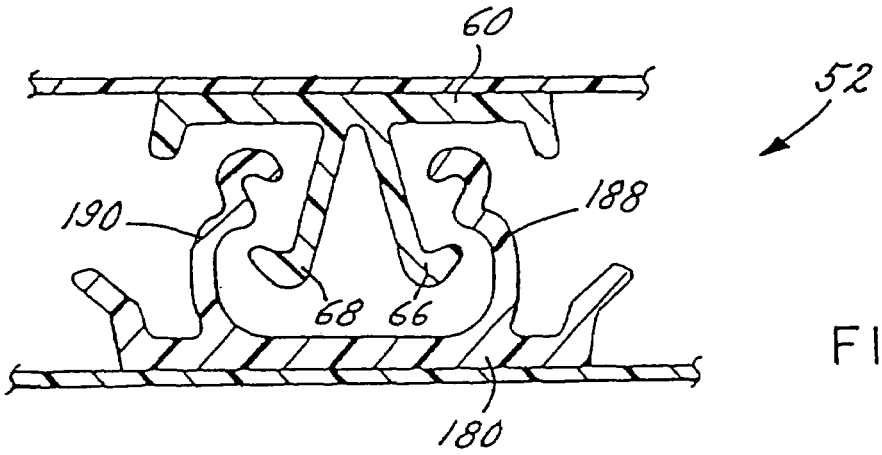
FIG. 9 is a cross-sectional view of another embodiment of the closure fastening device in accordance with the invention in an occluded vented position and having female webs which are relatively longer than the male webs of the male closure element.

FIG. 9 is similar to FIG. 5, except the first webs 188, 190 of the female element portion 180 are relatively longer than the first webs 66, 68 of the male element portion 60.

Figure 10:
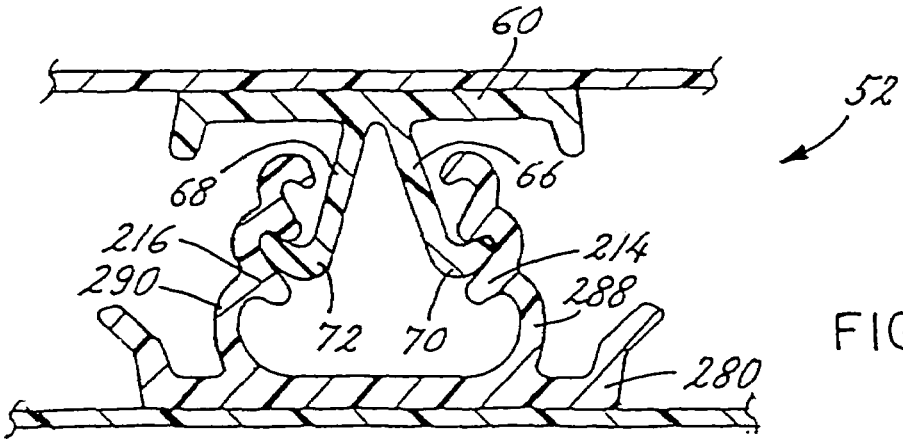
FIG. 10 is a cross-sectional view of another embodiment of the closure fastening device in accordance with the invention in an intermediate occluded position and having additional female hook portions or protrusions on the female closure element.
Figure 11:
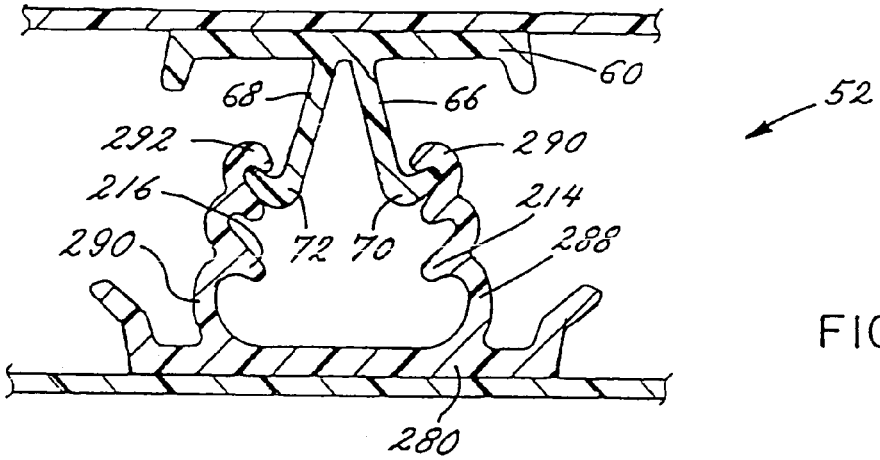
FIG. 11 is a cross-sectional view of the closure fastening device shown in FIG. 10 in an occluded closed position.

FIGS. 10-11 are similar to FIG. 5, except the first webs 288, 290 of the female element portion 280 include additional protrusions 214, 216 which engage the male hook portions 70, 72. This particular embodiment shows one set of protrusions 214, 216, however, the element portion may include as many protrusions as are desired, such as, two, three, four, etc. The male hook portions 70, 72 make contact with the additional protrusions 214, 216 as the user moves the male element portion 60 away from female element portion 280 from the venting position to the closed position. During this movement, the first webs 66, 68 are deflected toward each other as they move past the protrusions 214, 216 and provide a tactile "feel" as the user moves the male element portion and female element portion to the normally closed position.

Figure 12:
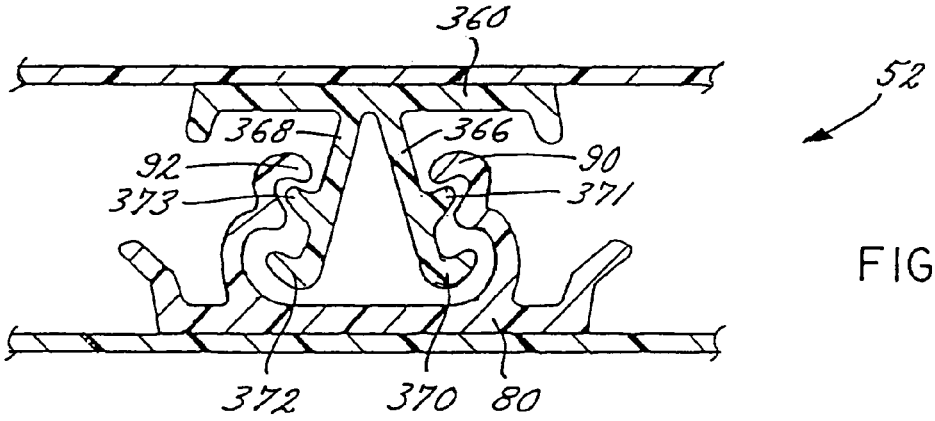
FIG. 12 is a cross-sectional view of another embodiment of the closure fastening device in accordance with the invention in an occluded vented position and having a male closure element with additional male hook portions or protrusions.
Figure 13:
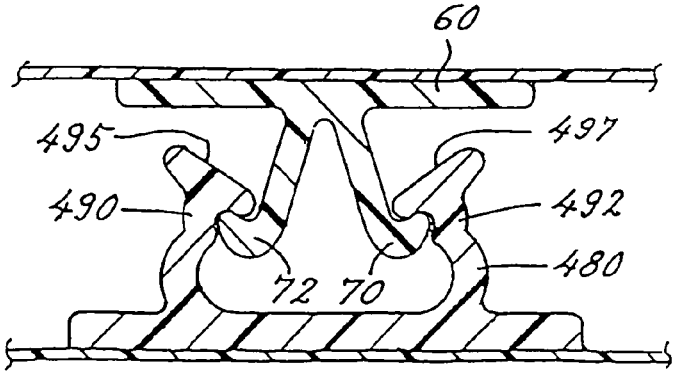
FIG. 13 is a cross-sectional view of another embodiment of the closure fastening device in accordance with the invention in an occluded closed position.

FIG. 12 is similar to FIG. 8, except the first webs 366, 368 include additional protrusions 371, 373. This particular embodiment shows one set of protusions 371, 373, however, the element portion may include as many protusions as are desired such as, two, three, four, etc. These additional protrusions 371, 373 would contact the female hook portions 90, 92 as the user moves the male element portion and female element portion from the vented position to the closed position. During this movement, the webs 366, 368 would be deflected toward each other as the protrusions 371, 373 move past the female hook portions 90, 92 and consequently provide a tactile "feel" to the user. FIG. 13 is similar to FIG. 2, except the female hook portions 490, 492 include guide surfaces 495, 497. The guide surfaces 495, 497 generally serve to guide the male hook portions 70, 72 for occlusion with the female mating closure element 480.

Figure 14:
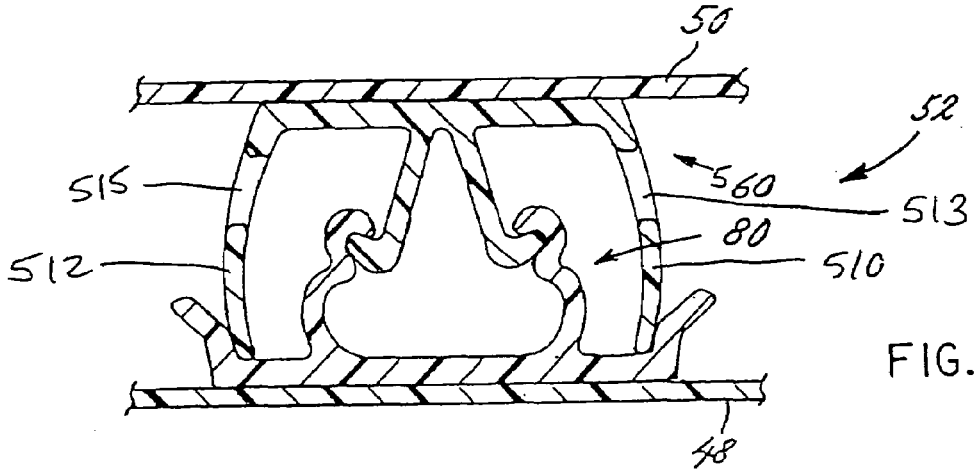
FIG. 14 is a cross-sectional view of another embodiment of the closure fastening device in accordance with the invention in an occluded closed position.

FIG. 14 is similar to FIG. 7, except the male element portion 560 has elongated second webs 510, 512. The second webs 510, 512 contact the female element portion 80 when the fastening device 52 is occluded. The second webs 510, 512 help to maintain the seal between the male and female hooks in the occluded closed position. Specifically, the second webs 510, 512 contact the female element portion 80 prior to the fastening device achieving the fully occluded closed position. When in the fully occluded closed position, the second webs 510, 512 will bend or deflect. This deflection biases the male and female element portions 560, 80 away from each other which helps to maintain the seal.

Figure 15:
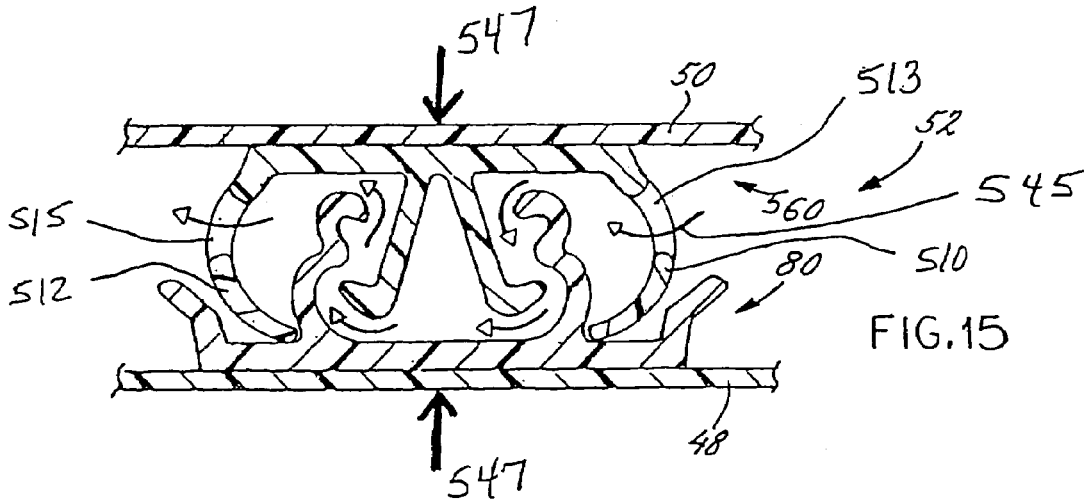
FIG. 15 is a cross-sectional view of the closure fastening device shown in FIG. 14 in an occluded vented position.

FIG. 15 shows the fastening device of FIG. 14 in the occluded vented position similar to FIG. 5. The second webs 510, 512 include openings 513, 515 which are positioned along the length of the male and female element portions 560, 80. The openings permit air to flow between the interior and the exterior of the container as shown by air flow 545.

In order to vent the fastening device in FIGS. 14 and 15, the user would apply a force 547 to the fastening device, such as, by pinching the flange portions 62, 82. The force 547 would be applied to further deflect the second webs 510, 512 and break the seal to achieve the occluded vented position as in FIG. 15. The user would press on the side walls 48, 50 to force the air from the interior to exterior of the container. Specifically, the air would pass between the element portions 80, 560 including through the openings 513, 515 in the second webs. After the user had completed the venting of the container, the user would remove the force and the male and female element portions would return to the occluded closed position shown in FIG. 14 due to the biasing force of the second webs 510, 512.

The methods noted above for FIGS. 1-7 could also be used with embodiments shown in FIGS. 8-15.

Generally, the closure elements of this invention that form the closure fastening devices may be formed from thermoplastic materials such as polyethylene, polypropylene, nylon or the like, or from a combination thereof. Thus, resins or mixtures of resins such as high density polyethylene, medium density polyethylene and low density polyethylene may be employed to prepare the novel closure device of this invention.

The particular coloration of the thermoplastic material may have an advantageous effect on the color change characteristics of the closure, since light dispersing properties of the colored thermoplastic material are important. For example, the male element portion may be translucent and the female element portion may be opaque. When the male and female element portions are occluded, a different color is provided for establishing visually the occlusion. The fastening device may also include a color change enhancement member or members as disclosed in U.S. Pat. No. 4,829,641. U.S. Pat. No. 4,829,641 is incorporated herein by reference in its entirety.

The closure fastening device of the invention may be manufactured by extrusion, or other known methods of producing such devices. The closure fastening device can be manufactured as individual closure elements for later attachment to a film, or the closure element portions can be manufactured integral with a film. In addition, the closure fastening device can be manufactured with or without flange portions on one or both of the closure elements depending upon the intended use or expected additional manufacturing operations.

In the practice of the instant invention, the closure fastening device may be integrally formed with the side walls of a container, or connected to a container, by the use of any of many known methods. A thermoelectric device can be applied to a film in contact with a flange portion of a closure element or the thermoelectric device can be applied to a film in contact with the base portion of a closure element having no flange portion, to cause a transfer of heat to the film to produce melting at the interface of the film and the flange portion or base portion of the closure element. The bonding of closure elements to the film stock may be carried out either before or after the film is U-folded, but in any event is done prior to the side sealing of the bags at the edges by conventional thermocutting. The thermoelectric device can be heated rotary discs, or resistance heated slide wires, or travelling heater bands, or the like. The connection between the film and the closure element can be established by the use of hot melt adhesives, hot jets of air to the interface, ultrasonic heating, or other known methods. Generally, the closure fastening device and the films that form the body of the bag can be made from a heat sealable material so that a container can be formed economically by heat sealing the aforementioned components to form the container using thermoplastics of the type aforementioned for formation of the closure elements.

In addition, the closure fastening device can be designed so that it is more difficult to deocclude from the inside of the containers than from the outside of the containers, thereby providing more secure containment of goods such as food products. The element portions of the closure device have approximately uniform cross-sections. This not only simplifies the manufacturing of the device, but it also contributes to the physical flexibility of the device, which is a desirable property.

Generally, the closure fastening device of this invention can be manufactured in a variety of forms to suit the intended use. In addition, the male and female closure elements can be positioned on opposite side of a film. Such an embodiment would be suited for enwrapping an object or a collection of objects such as wires. Generally, the male and female closure elements on a film should be parallel to each other, but this would depend on the intended use.

While particular embodiments of the invention have been shown, it will be understood that the invention is not limited thereto since modifications may be made by those skilled in the art, particularly in light of the foregoing teachings. It is, therefore, contemplated by the appended claims to cover any such modifications as may be included within the spirit and scope of the invention as defined by the appended claims.

What is claimed is:

1. An interlocking closure device for use with a flexible container having two side walls and an interior volume therein comprising:

a first hook shaped closure element and a second mating hook shaped closure element arranged to be interlocked over a predetermined length, said first closure element engages said second closure element in a first engaged position wherein a fluid from the interior volume can flow past and between the first and second closure elements to outside ambient when in said first engaged position, said first closure element engages said second closure element in a second engaged position wherein a fluid from the interior volume cannot substantially flow past the interlocking closure device to outside ambient when in said second engaged position.

2. The invention as in claim 1 wherein said first closure element includes a base portion having a pair of elongate, spaced apart outwardly extending webs.

3. The invention as in claim 2 wherein said first closure element includes male hooks.

4. The invention as in claim 3 wherein said male hooks include guide surfaces to guide said male hooks with said female hooks.

5. The invention as in claim 3 wherein each of said webs includes male hooks.

6. The invention as in claim 2 wherein said first closure element further comprises an outer pair of webs connected to the base portion.

7. The invention as in claim 1 wherein said second closure element includes a base portion having a pair of elongate, spaced apart outwardly extending webs.

8. The invention as in claim 7 wherein said second closure element includes female hooks.

9. The invention as in claim 8 wherein said female hooks include guide surfaces to guide said female hooks with said male hooks.

10. The invention as in claim 8 wherein each of said webs includes female hooks.

11. The invention as in claim 7 wherein said second closure element further comprises an outer pair of webs connected to the base portion.

12. The invention as in claim 11 wherein said outer pair of webs includes guide surfaces.

13. The invention as in claim 1 wherein said first closure element is taller than said second closure element.

14. The invention as in claim 1 wherein said first closure element includes a color different than said second closure element.

15. The invention as in claim 14 wherein at least one of said closure elements is translucent.

16. The invention as in claim 14 wherein said closure elements provide a color different from the closure elements when said closure elements are in said first engaged position.

17. The invention as in claim 14 wherein said closure elements provide a color different from the closure elements when said closure elements are in said second engaged position.

18. The invention as in claim 14 wherein said first closure element includes a color change enhancement member.

19. The invention as in claim 18 wherein said color change enhancement member is integrally associated with said first closure element.

20. A flexible container comprising two side walls, an interlocking closure device and an interior volume therein, the interlocking closure device including:

a first hooked shaped closure element and a second mating hook shaped closure element arranged to be interlocked over a predetermined length, said first closure element engages said second closure element in a first engaged position wherein a fluid can flow past and between the first and second closure elements and between the interior volume of the container and an exterior of the container when in said first engaged position, said first closure element engages said second closure element in a second engaged position wherein a fluid cannot substantially flow between the interior volume of the container and an exterior of the container when in said second engaged position.

21. The invention as in claim 20 wherein said first closure element includes a base portion having a pair of elongate, spaced apart outwardly extending webs.

22. The invention as in claim 21 wherein said first closure element includes male hooks.

23. The invention as in claim 22 wherein said male hooks include guide surfaces to guide said male hooks with said female hooks.

24. The invention as in claim 22 wherein each of said webs includes male hooks.

25. The invention as in claim 21 wherein said first closure element further comprises an outer pair of webs connected to the base portion.

26. The invention as in claim 20 wherein said second closure element includes a base portion having a pair of elongate, spaced apart outwardly extending webs.

27. The invention as in claim 26 wherein said second closure element includes female hooks.

28. The invention as in claim 27 wherein said female hooks include guide surfaces to guide said female hooks with said male hooks.

29. The invention as in claim 27 wherein each of said webs includes female hooks.

30. The invention as in claim 26 wherein said second closure element further comprises an outer pair of webs connected to the base portion.

31. The invention as in claim 30 wherein said outer pair of webs includes guide surfaces.

32. The invention as in claim 20 wherein said first closure element is taller than said second closure element.

33. The invention as in claim 20 wherein said first closure element includes a color different than said second closure element.

34. The invention as in claim 33 wherein at least one of said closure elements is translucent.

35. The invention as in claim 33 wherein said closure elements provide a color different from the closure elements when said closure elements are in said first engaged position.

36. The invention as in claim 33 wherein said closure elements provide a color different from the closure elements when said closure elements are in said second engaged position.

37. The invention as in claim 33 wherein said first closure element includes a color change enhancement member.

38. The invention as in claim 37 wherein said color change enhancement member is integrally associated with said first closure element.

39. A method for venting fluids from a container including two side walls and an interlocking closure device, the interlocking closure device including a first closure element and a second closure element arranged to be interlocked over a predetermined length, the method comprising the steps of:

engaging said first closure element and said second closure element in a first engaged position;

applying pressure to said container wherein a fluid flows between said first closure element and said second closure element when in said first engaged position; and engaging said first closure element and said second closure element in a second engaged position wherein a fluid cannot substantially flow between said first closure element and said second closure element when in said second engaged position.

* * * * *